US007388963B2

(12) United States Patent
Han et al.

(10) Patent No.: US 7,388,963 B2
(45) Date of Patent: Jun. 17, 2008

(54) SPEAKER APPARATUS

(75) Inventors: Sang-hyun Han, Suwon (KR); Woo-nam Byun, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 443 days.

(21) Appl. No.: 10/811,854

(22) Filed: Mar. 30, 2004

(65) Prior Publication Data

US 2004/0196999 A1 Oct. 7, 2004

(30) Foreign Application Priority Data

Apr. 1, 2003 (KR) ..... 10-2003-0020500

(51) Int. Cl.
*H04R 25/00* (2006.01)

(52) U.S. Cl. ..... 381/397; 381/345; 381/165

(58) Field of Classification Search ..... 381/345, 381/351, 355, 386, 189, 397, 349, 350, 160, 381/161, 164, 304, 305, 335–338, 165; 181/155, 181/156, 198, 199, 145, 148, 153
See application file for complete search history.

(56) References Cited

U.S. PATENT DOCUMENTS 3,778,551 A * 12/1973 Grodinsky ..... 381/335
4,210,778 A * 7/1980 Sakurai et al. ..... 381/349
5,025,885 A * 6/1991 Froeschle ..... 181/156
5,097,513 A * 3/1992 Jordan et al. ..... 381/160
5,189,706 A * 2/1993 Saeki ..... 381/349
5,771,302 A * 6/1998 Schindler ..... 381/345
5,864,100 A * 1/1999 Newman ..... 181/156
5,995,634 A * 11/1999 Zwolski ..... 381/160
6,956,956 B2 * 10/2005 Kuratani et al. ..... 381/397

FOREIGN PATENT DOCUMENTS

| | | |
|---|---|---|
| JP | 2002-191093 | 7/2002 |
| KR | 1998-62184 | 11/1998 |
| KR | 2000-16928 | 9/2000 |
| KR | 20-218617 | 1/2001 |

* cited by examiner

*Primary Examiner*—Huyen Le
(74) *Attorney, Agent, or Firm*—Staas & Halsey LLP

(57) ABSTRACT

A speaker apparatus includes a speaker, and a circuit to operate the speaker. The speaker apparatus further includes a speaker box having an opening to enclose a back of the speaker; a casing accommodating the speaker box combined with the speaker and the circuit therein, and communicating with an outside so as to dissipate heat from the circuit; and a duct penetrating the casing and the speaker box so as to emit back sound of the speaker. The present invention provides a speaker apparatus, which has high heat-dissipating efficiency, can be manufactured in various designs, and prevents a user from being burned.

24 Claims, 4 Drawing Sheets

SPEAKER APPARATUS

CROSS-REFERENCE TO RELATED APPLICATIONS

This application claims the benefit of Korean Patent Application No. 2003-20500, filed Apr. 1, 2003, in the Korean Intellectual Property Office, the disclosure of which is incorporated herein by reference.

BACKGROUND OF THE INVENTION

1. Field of the Invention

The present invention relates to a speaker apparatus, and more particularly, to a speaker apparatus having an improved structure to dissipate heat, which is generated from an internal circuit thereof.

2. Description of the Related Art

A speaker apparatus converting electrical energy into sound energy typically comprises a speaker and a casing part, which encloses the speaker. The speaker may have various structures and functions as are necessary. For example, the speaker apparatus may include a circuit such as an amplifier to amplify sound. Further, more recently, various speaker apparatuses for use in a home theater system have been developed.

In the case where the speaker apparatus includes the circuit, such as an amplifier, which generates a relatively large amount of heat, there is provided a radiator to dissipate the heat from the circuit.

As shown in FIG. 1, a conventional speaker apparatus 101 comprises a speaker 103 generating bass sound, a casing 110 enclosing the speaker unit 103, a circuit 105 placed inside the casing 110, a duct through which back sound of the speaker 103 is emitted, and a radiator 170, which conductively dissipates the heat from the circuit 105 by conduction.

The casing 110 encloses the speaker 103, having a hole formed by the duct 150 to emit the back sound of the speaker 103, in consideration of the quality of sound.

The circuit 105 comprises elements such as a transistor, so that a relatively large amount of heat is generated therefrom. Therefore, the radiator 170, exposed to the outside of the speaker, is attached on the circuit 105.

Thus, the conventional speaker apparatus 101 maintains the quality of sound by enclosing the speaker 103 with the casing 110, and dissipates the heat from the circuit 105 by attaching the radiator 170 on the circuit 105.

However, in the conventional speaker apparatus 101, the heat from the circuit 105 is dissipated by conduction through the radiator 170, so that heat-dissipating efficiency is relatively low and high temperature air is likely to be generated inside the casing 110, wherein the high temperature air causes the elements placed inside the casing 110 to be damaged or displaced.

Further, in the conventional speaker apparatus 101, the radiator 170 should be exposed to the outside of the casing 110, so that the radiator 170 limits design of the casing 110. Also, a user may get burned because of the hot radiator 170.

SUMMARY OF THE INVENTION

Accordingly, it is an aspect of the present invention to provide a speaker apparatus which has high heat-dissipating efficiency, can be manufactured in various designs, and prevents a user from being burned.

The foregoing and/or other aspects of the present invention are achieved by providing a speaker apparatus comprising a speaker, and a circuit to operate the speaker, further comprising: a speaker box having an opening to enclose a back of the speaker; a casing accommodating the speaker box, combined with the speaker and the circuit therein, communicating with an outside so as to dissipate heat from the circuit; and a duct penetrating the casing and the speaker box so as to emit back sound of the speaker.

According to an aspect of the invention, the speaker box is accommodated in the casing, leaving a space between the speaker box and the casing, and the circuit is accommodated in the casing, being disposed above the speaker box.

According to an aspect of the invention, the casing has an upper part and a lower part, which are opened respectively.

According to an aspect of the invention, the speaker apparatus further comprises a base member supporting the lower part of the casing, and allowing external air to enter the casing; and a top member provided on the upper part of the casing, allowing air to flow out from the casing.

According to an aspect of the invention, the base member slopes upwardly to a center thereof so as to guide air inflow, and the top member slopes downwardly to a center thereof so as to guide air outflow.

According to an aspect of the invention, the speaker apparatus further comprises a speaker supporter provided between the base member and the lower part of the casing so as to support the speaker and the lower part of the casing; and a top supporter provided between the top member and the upper part of the casing so as to support the top member.

According to an aspect of the invention, on the casing is mounted a control panel electrically connected to the circuit and the speaker.

According to an aspect of the invention, the circuit includes an amplifying circuit to amplify sound.

According to an aspect of the invention, the speaker includes a bass speaker.

According to an aspect of the invention, the casing is shaped like a cylinder having opposite openings, and the speaker box is shaped like a cylinder having one opening.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
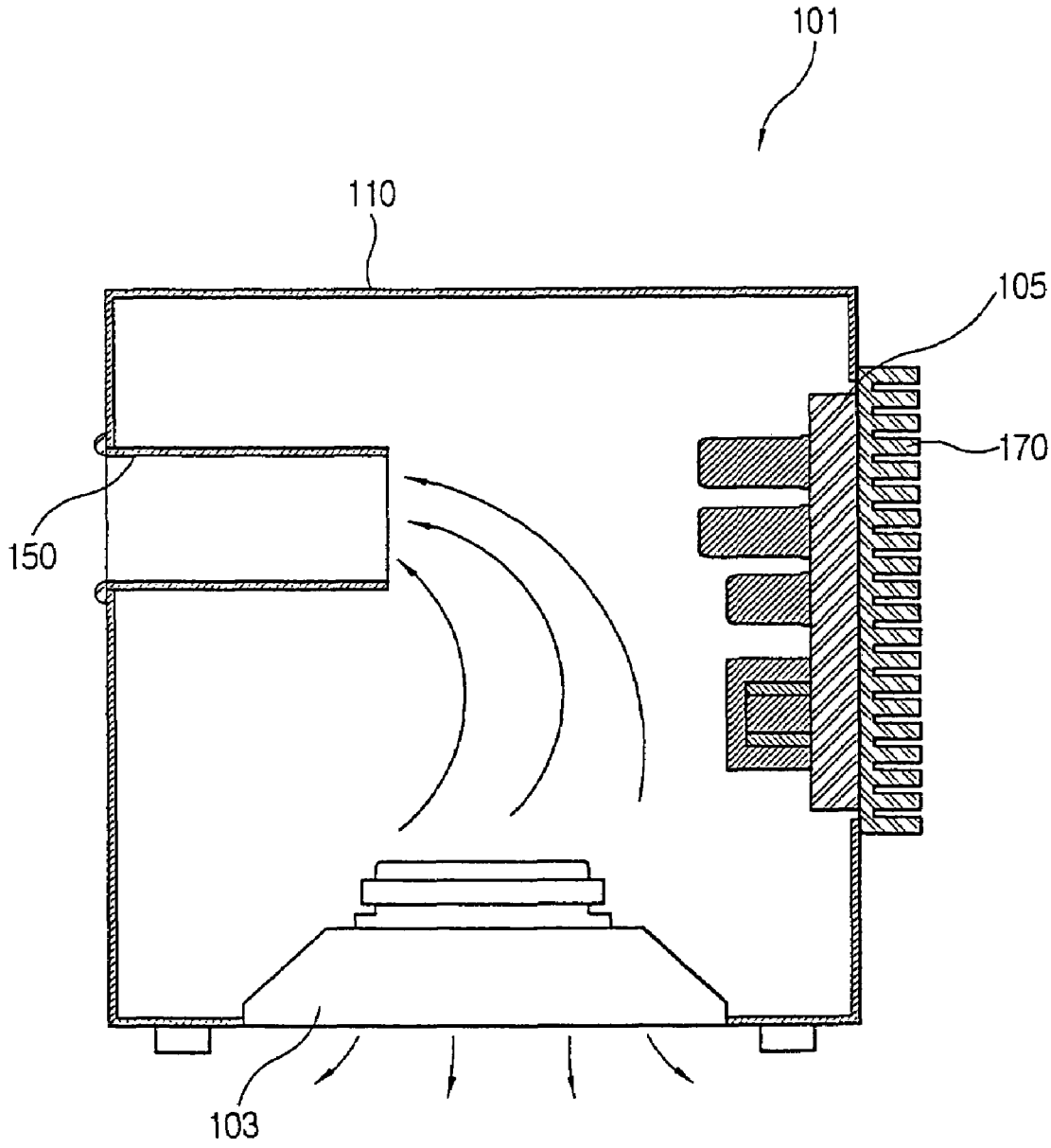
FIG. 1 (PRIOR ART)
FIG. 1 is a sectional view of a conventional speaker.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
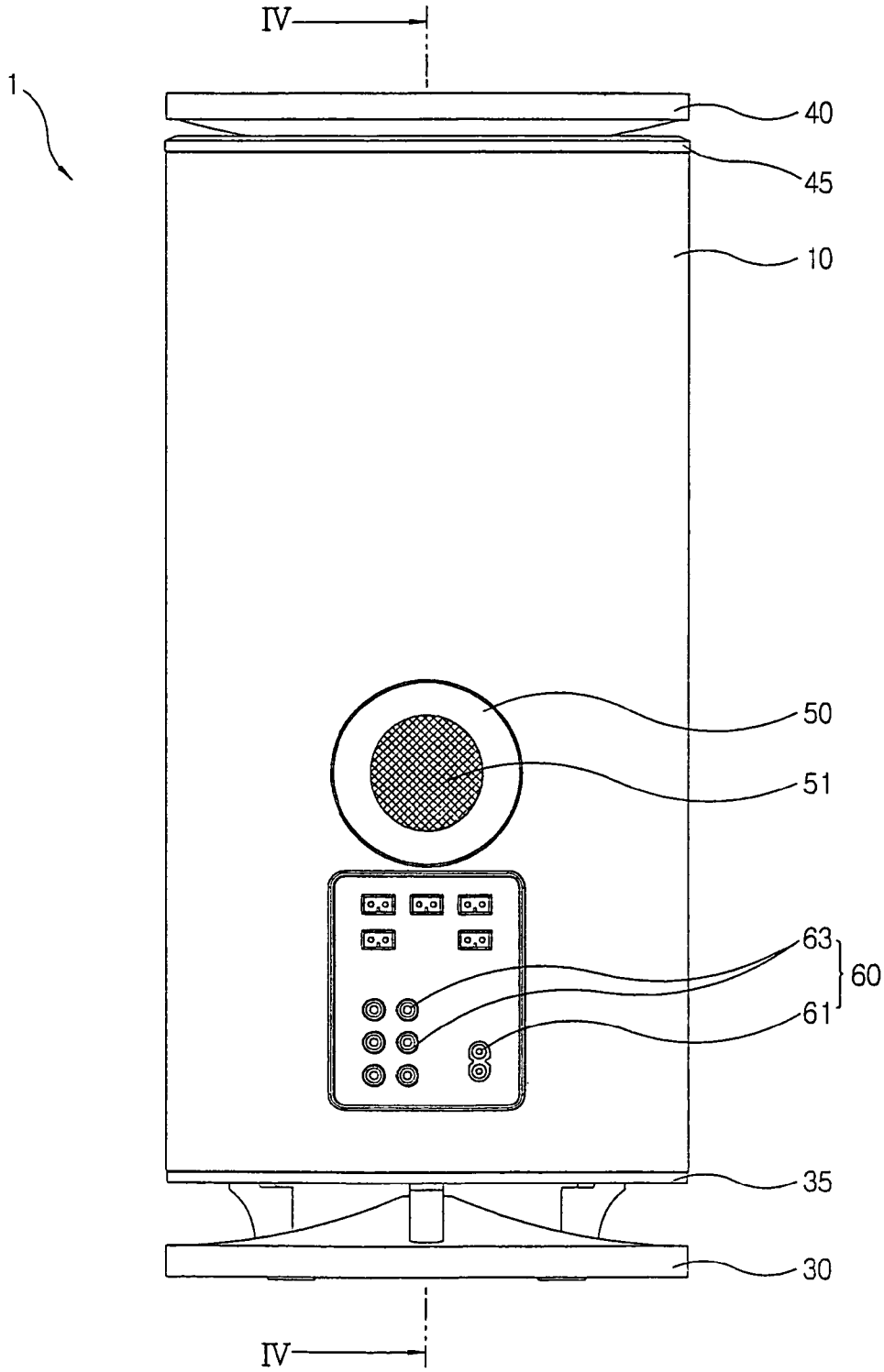
FIG. 2 is a front view of a speaker according to the present invention.
Figure 3:
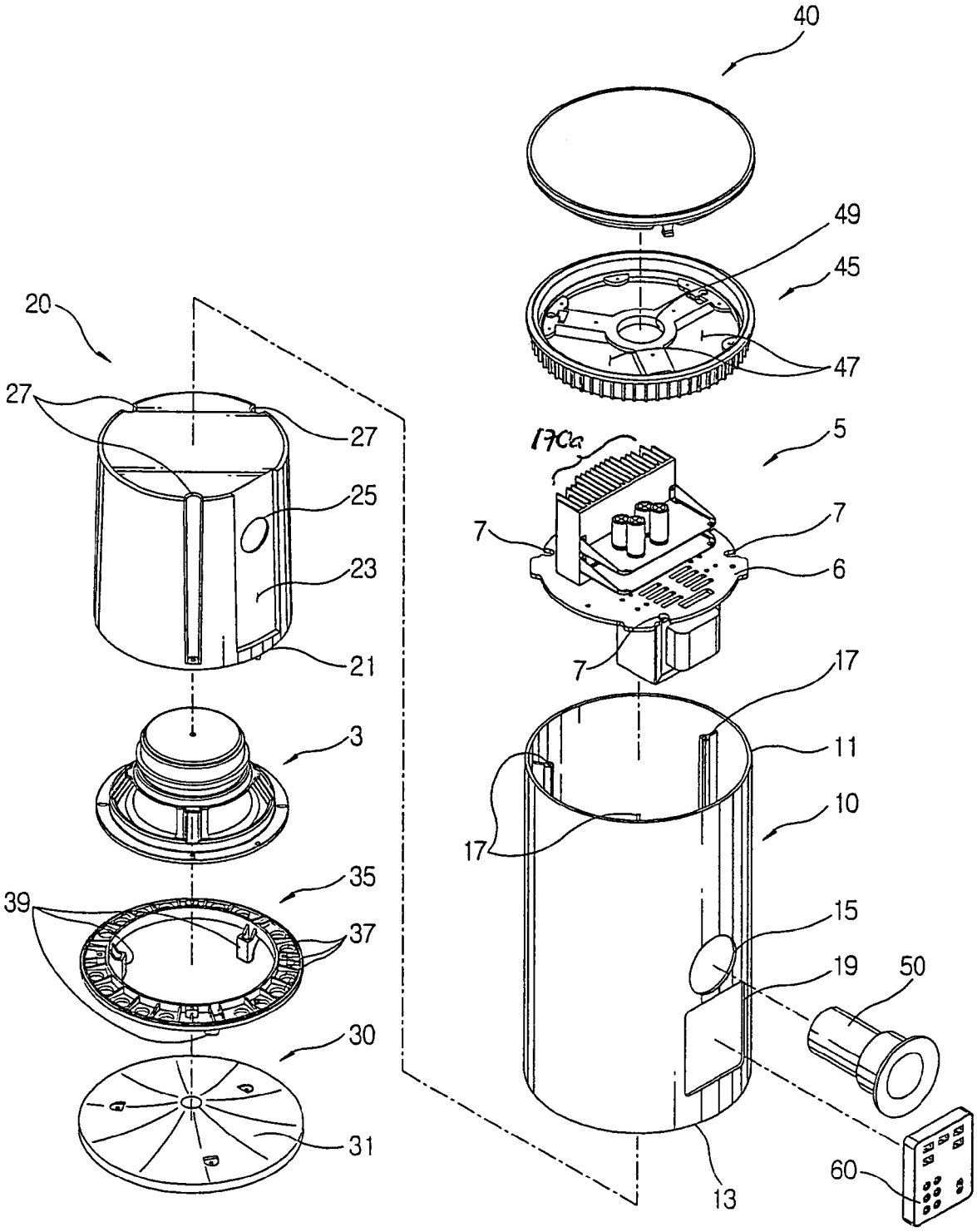
FIG. 3 is an exploded perspective view of the speaker of FIG. 2.
Figure 4:
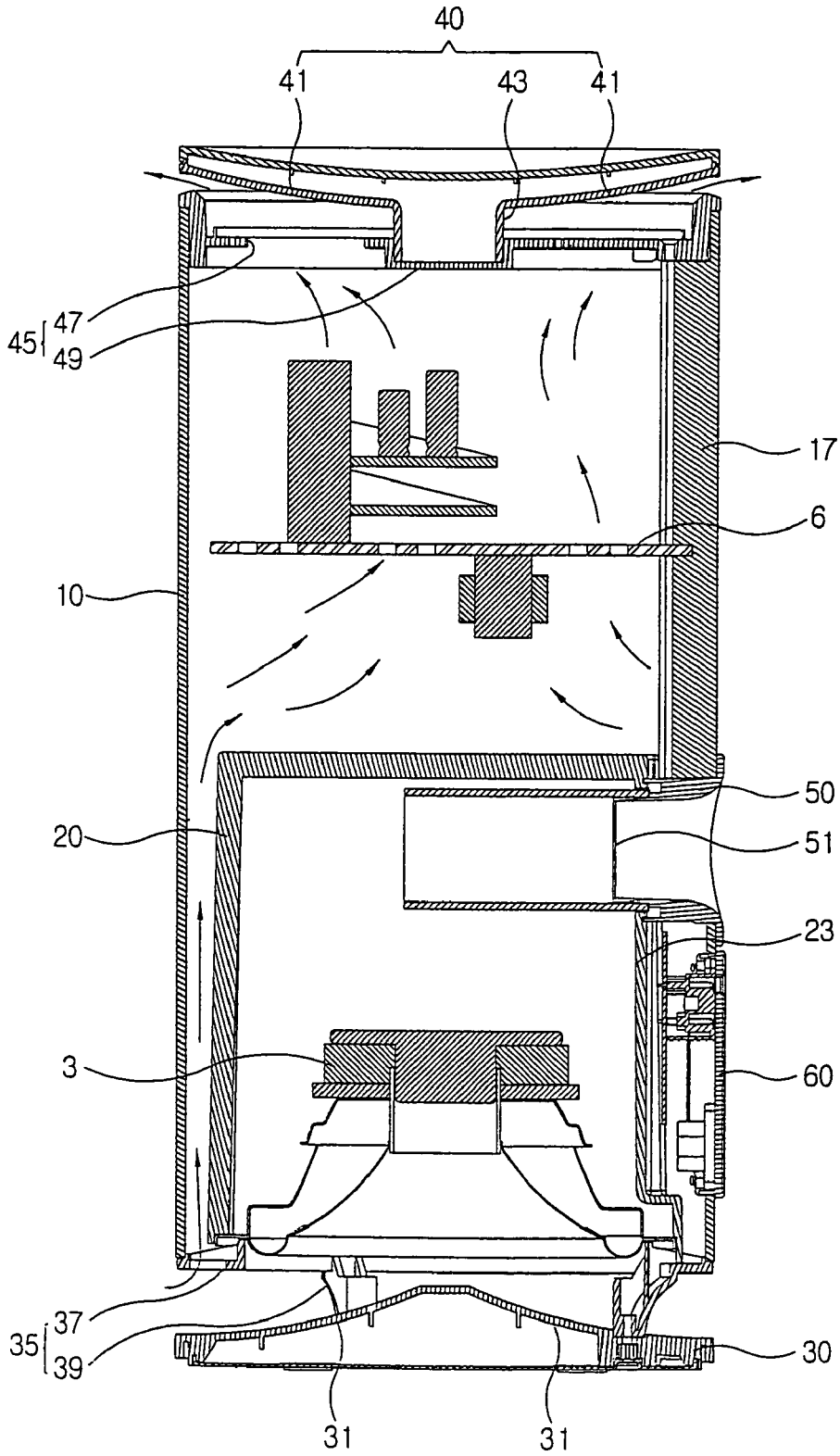
FIG. 4 is a sectional view of the speaker, taken along line IV-IV in FIG. 2.

As shown in FIGS. 2 through 4, a speaker apparatus 1 according to the present invention comprises a speaker 3, a circuit 5 to operate the speaker 3, a speaker box 20 having an open bottom to enclose a back of the speaker 3, a casing 10 accommodating the speaker box 20 and the circuit 5 therein, and a duct 50 penetrating the casing 10 and the speaker box 20 so as to emit back sound of the speaker 3.

Further, the speaker apparatus 1 comprises a base member 30 supporting a lower part 13 of the casing 10, and a top member 40 provided on an upper part 11 of the casing 10.

The speaker 3 is combined with the open bottom of the speaker box 20, which converts electrical energy into sound energy. In this embodiment, the speaker 3 includes a base speaker.

The circuit 5 is employed in operating the speaker 3, and includes an amplifier such as a transistor or a vacuum tube, wherein the transistor or the vacuum tube generates a relatively large amount of heat. In this embodiment, the circuit 5 is disposed above the speaker box 20 and is accommodated in the casing 10. Further, the circuit 5 comprises a substrate 6 on which elements such as transistors are mounted, and a plurality of supporter grooves 7 provided in a rim of the substrate 6 so as to respectively accommodate supporters 17 of the casing 10. Additionally, fins 170*a* are included on the circuit 5 to dissipate heat generated by the circuit 5.

The substrate 6 is formed with a plurality of air through holes through which air passes, and is shaped like a circular plate. However, the substrate may have various shapes corresponding to the shape of the casing, for example, a rectangular shape, a polygonal shape, etc.

The casing 10 is combined with the speaker box 20 and the circuit 5, and accommodates the speaker box 20 and the circuit 5 therein. The inside of the casing 10 communicates with the outside so as to dissipate heat from the circuit 5. The casing 10 is shaped like a cylinder, and the upper and lower parts 11 and 13 thereof have an open top and bottom, respectively. The casing 10 is provided with a plurality of supporters 17 protruding from an inner surface thereof. Further, the casing 10 is formed with a panel hole 19, in which a control panel 60, electrically connected to the circuit 5 and the speaker 3, is inserted. The casing 10 is also formed with a first duct hole 15 through which the duct 50 is inserted. Here, the casing 10 has a circular cross-section, but may have various cross-sections such as a rectangular cross-section, a polygonal cross-section, etc.

The supporter 17 is fitted into the supporter groove 7 of the circuit 5 and a supporter holder 27 of the speaker box 20, and combines the circuit 5 and the speaker box 20 to the casing 10. In this embodiment, three supporters 17 are provided on the inner surface of the casing 10, being spaced at equal intervals. However, the number of the supporter 17 may be less than or more than three.

The control panel 60 comprises a power switch 61 to turn the speaker 3 and the circuit 5 on and off, and a plurality of jacks 63. Here, the circuit 5 includes the amplifier to amplify sound, so that the speaker apparatus 1, according to the present invention, is connected to a plurality of other speaker units through the jacks 63, thereby supporting 5.1 channels of a home theater system.

The speaker box 20 is shaped like a cylinder having the open bottom to enclose the back of the speaker 3, and is accommodated in the casing 10, leaving a space between the speaker box 20 and the casing 10. The speaker box 20 comprises a speaker combination part 21 to which the speaker 3 is combined with a screw or the like, a recessed part 23 in which the back of the control panel 60 is accommodated while passing through the casing 10, a second duct hole 25 through which the duct 50, passed through the first duct hole 15, is inserted, and the plurality of supporter holders 27 into which the supporters 17 of the casing 10 are fitted. In an embodiment of the invention, the speaker box 20 is airtight except the second duct hole 25 and the open bottom of the speaker combination part 21 so as to emit the back sound of the speaker 3 in consideration of the quality of sound. Here, the speaker box 20 has a circular cross-section, but may have various cross-sections such as a rectangular cross-section, a polygonal cross-section, etc.

The duct 50 is shaped like a pipe, which passes through the first duct hole 15 of the casing 10 and the second duct hole 25 of the speaker box 20. Further, one end of the duct 50 is covered with a mesh 51 to prevent foreign objects from entering the speaker box 20. Thus, the back sound of the speaker 3 is emitted through the duct 50.

The base member 30 supports the lower part 13 of the casing 10, allowing external air to enter the casing 10. In an embodiment of the invention, the base member 30 includes an upward sloping part 31 sloping upwardly to a center thereof so as to readily guide the external air. Between the base member 30 and the lower part 13 of the casing 10 is provided a speaker supporter 35 to support the speaker 3 and the lower part 13 of the casing 10.

The speaker supporter 35 comprises a plurality of air through holes 37 through which the external air enters a passage formed between the inner surface of the casing 10 and the outer surface of the speaker box 20, and a plurality of base combination parts 39 to be combined with the base member 30 by a connecting member.

In an embodiment of the invention, the number of the base combination parts 39 is three, but may be more than three.

The top member 40 is provided on the upper part 11 of the casing 10, allowing air to flow out from the casing 10. The top member 40 includes a downward sloping part 41 sloping downwardly to a center thereof so as to readily guide the air flowing out from the casing 10, and a projection 43 protruding downward from the center of the downward sloping part 41 and a projection accommodating part 49 of a top supporter 45. The top supporter 45 is provided between the top member 40 and the upper part 11 of the casing 10 so as to support the top member 40.

The top supporter 45 includes a plurality of air through holes 47 through which high temperature air flows out from the casing 10, and the projection accommodating part 49 to accommodate the projection 43 provided on the bottom of the top member 40.

Here, the base member 30 and the top member 40 are shaped like a circular plate, but may have various shapes corresponding to the shape of the casing, for example, a rectangular shape, a polygonal shape, etc. Further, the speaker supporter 35 and the top supporter 45 are shaped like a circular plate, but may have various shapes corresponding to the shapes of the base member and the top member, respectively.

With this configuration, the process of assembling the speaker apparatus 1 will be described hereinbelow.

First, the speaker 3 is combined with the speaker combination part 21, of the speaker box 20, by connecting members. Thereafter, the speaker box 20 is accommodated in and combined with the casing 10. At this time, the supporters 17 of the casing 10 are fitted into the supporter holders 27 of the speaker box 20. Here, to reinforce the combination of the casing 10 and the speaker box 20, connecting member combinations may be added to the combination of the supporters 17 and the supporter holders 27.

The circuit 5 is then accommodated in the casing 10, being disposed above the speaker box 20. At this time, the supporters 17 of the casing 10 are fitted into the supporter grooves 7 formed in the substrate 6 of the circuit 5. Here, to reinforce the combination of the casing 10 and the circuit 5, the connecting member combination may be added to the combination of the supporters 17 and the supporter grooves 7.

Thereafter, the speaker supporter 35 is combined to both the lower part 13 of the casing 10 and the speaker 3 by the connecting member, and the top supporter 45 is combined to the upper part 11 of the casing 10 by the connecting member.

Thereafter, the base member 30 is combined to the base combination part 39 of the speaker supporter 35 by the screw connecting member. Further, the top member 40 is combined to the top supporter 45 by inserting the projection of the top member 40 into the projection accommodating part 49 of the top supporter 45, Here, to reinforce the combination of the top member 40 and the top supporter 45, the connecting member combination may be added to the combination of the projection 43 and the projection accommodating part 49.

Thereafter, the duct 50 is inserted in the casing 10, passing through the first duct hole 15 of the casing 10 and the second duct hole 25 of the speaker box 20 sequentially. Further, the control panel 60 is inserted in the panel hole 19 of the casing 10. Similarly, the connecting member combination may be used in combining the duct 50 to the casing 10 and/or the control panel 60 to the casing 10.

The speaker apparatus 1 according to the present invention dissipates the heat from the circuit 5 as follows.

As the speaker apparatus 1 operates, the circuit 5 generates a relatively large amount of heat, so that the temperature of the air inside the casing 10 rises. The high temperature air rises by convection and is dissipated through an opening between the upper part 11 of the casing 10 and the top member 40. Simultaneously, the external air enters the casing 10 through an opening between the lower part 13 of the casing 10 and the base member 30, and absorbs the heat from the circuit 5. Then, the air, having entered through the lower part 13, and having absorbed the heat from the circuit 5, rises with the resultant convection current. Thus, the air circulates inside the casing 10, thereby cooling the circuit 5.

As described above, the speaker apparatus 1 according to the present invention comprises the speaker box 20, so that not only the quality of sound related to the back sound of the speaker 3 is maintained but also the external air can enter the casing 10 and circulates therein to cool the circuit 5. In comparison with the conventional speaker apparatus having the radiator dissipating the heat from the circuit by conduction, the speaker apparatus according to the present invention dissipates the heat from the circuit by convection, thereby not only increasing heat-dissipating efficiency but also preventing the elements placed inside the casing from being out of order. Further, the speaker apparatus according to the present invention does not comprise the radiator, so that the casing can be manufactured in various designs. Also, a user can be prevented from being burned because of the hot radiator.

As described above, the present invention provides a speaker apparatus which has high heat-dissipating efficiency, can be manufactured in various designs, and prevents a user from being burned.

Further as described above, a speaker apparatus 1, including a speaker 3 and a circuit 5 having fins 170*a* protruding therefrom to operate the speaker 3, comprises a speaker box 20, a casing 10, and a duct 50. The speaker box 20, including a first duct hole 15, encloses a back of the speaker. The casing 10, into which the speaker box 20 is insertably held and in which the circuit 5 is to be accommodated, has first and second openings and a second duct hole 25, the second duct hole 25 being substantially coaxial with the first duct hole 15 when the speaker box 20 is held in the casing 10. Lastly, the duct 50, penetrating the first and second duct holes 15 and 25, emits sound emanating from the speaker 3, wherein external air enters and exits the casing 10 through the first and second openings and circulates therein to cool the circuit 5 by dissipating heat through the fins 170*a* as the air contacts the fins 170*a*.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A speaker apparatus, including a speaker, and a circuit to operate the speaker, comprising:

a speaker box, having an opening, to enclose a back of the speaker;

a casing, accommodating the speaker box combined with the speaker and the circuit therein, to communicate with an outside to dissipate heat from the circuit, the casing defining a passage to pass air to the circuit, the passage having a varying size upstream from the circuit along a flow direction of the air; and a duct, penetrating the casing and the speaker box, to emit back sound of the speaker, wherein the speaker box is accommodated in the casing, to leave a space between the speaker box and the casing, and the circuit is accommodated in the casing, being disposed above the speaker box.

2. The speaker apparatus according to claim 1, wherein the casing has an upper part and a lower part, both parts being opened, respectively.

3. The speaker apparatus according to claim 2, further comprising:

a base member supporting the lower part of the casing, allowing external air to enter the casing; and a top member provided on the upper part of the casing, allowing air to flow out from the casing.

4. The speaker apparatus according to claim 3, wherein the base member slopes upwardly to a center thereof to guide air inflow, and the top member slopes downwardly to a center thereof to guide air outflow.

5. The speaker apparatus according to claim 4, further comprising:

a speaker supporter provided between the base member and the lower part of the casing to support the speaker and the lower part of the casing; and a top supporter provided between the top member and the upper part of the casing so as to support the top member.

6. The speaker apparatus according to claim 5, wherein a control panel, which is electrically connected to the circuit and the speaker, is mounted on the casing.

7. A speaker apparatus, including a speaker, and a circuit to operate the speaker, comprising:

a speaker box, having an opening, to enclose a back of the speaker;

a casing, accommodating the speaker box combined with the speaker and the circuit therein, to communicate with an outside to dissipate heat from the circuit, the casing defining a passage to pass air to the circuit, the passage having a varying size upstream from the circuit along a flow direction of the air; and a duct, penetrating the casing and the speaker box, to emit back sound of the speaker, wherein the circuit includes an amplifying circuit to amplify sound.

8. The speaker apparatus according to claim 7, wherein the speaker includes a bass speaker.

9. The speaker apparatus according to claim 8, wherein the casing is shaped like a cylinder having opposite openings, and the speaker box is shaped like a cylinder having one opening.

10. A speaker apparatus, including a speaker and a circuit to operate the speaker, comprising:

a speaker box, including a first duct hole, to enclose a back of the speaker;

a casing, into which the speaker box is insertably held and in which the circuit is to be accommodated, having first and second openings and a second duct hole, the second duct hole being substantially coaxial with the first duct hole when the speaker box is held in the casing;

a duct, penetrating the first and second duct holes, to emit sound emanating from the speaker, wherein air enters and exits the casing through the first and second openings and to cool the circuit.

11. The speaker apparatus according to claim 10, further comprising a space between the speaker box and the casing through which the entering and exiting air flows.

12. The speaker apparatus according to claim 11, wherein the circuit is disposed above the speaker box in the casing.

13. The speaker apparatus according to claim 11, further comprising upper and lower parts of the casing, wherein the first and second openings of the casing are in the upper and lower parts of the casing, respectively.

14. The speaker apparatus according to claim 13, further comprising a base member, to support the lower part of the casing, and to allow external air to enter the casing.

15. The speaker apparatus according to claim 14, further comprising a top member, on the upper part of the casing, to allow air to flow out from the casing.

16. The speaker apparatus according to claim 15, wherein the base member and the top member each comprise a center, wherein the base member slopes upwardly toward the center of the base member, and the top member slopes downwardly toward the center of the top member.

17. The speaker apparatus according to claim 16, further comprising a speaker supporter between the lower part of the casing and the base member to support the speaker and the lower part of the casing.

18. The speaker apparatus according to claim 17, further comprising a top supporter provided between the top member and the upper part of the casing to support the top member.

19. The speaker apparatus according to claim 18, further comprising a control panel, mounted on the casing, which is electrically connected to the circuit and the speaker.

20. The speaker apparatus according to claim 10, wherein the circuit comprises an amplifying circuit to amplify sound.

21. The speaker apparatus according to claim 20, wherein the speaker comprises a bass speaker.

22. The speaker apparatus according to claim 21, wherein the casing is cylindrical and stands with a first end lower than a second end, wherein the first and second openings are located at the first and second ends, respectively.

23. A speaker apparatus, including a speaker and a circuit to operate the speaker, comprising:

a speaker box, including a first duct hole, to enclose a back of the speaker;

a casing, into which the speaker box is insertably held and in which the circuit is to be accommodated, having first and second openings and a second duct hole, the second duct hole being substantially coaxial with the first duct hole when the speaker box is held in the casing;

a duct, penetrating the first and second duct holes, to emit sound emanating from the speaker, wherein external air enters and exits the casing through the first and second openings and circulates therein to cool the circuit.

24. A speaker apparatus, including a speaker and a circuit having fins protruding therefrom to operate the speaker, comprising:

a speaker box, including a first duct hole, to enclose a back of the speaker;

a casing, into which the speaker box is insertably held and in which the circuit is to be accommodated, having first and second openings and a second duct hole, the second duct hole being substantially coaxial with the first duct hole when the speaker box is held in the casing;

a duct, penetrating the first and second duct holes, to emit sound emanating from the speaker, wherein external air enters and exits the casing through the first and second openings and circulates therein to cool the circuit by dissipating heat through the fins as the air contacts the fins.

* * * * *